US005160667A

United States Patent [19]

Gross et al.

[11] Patent Number: 5,160,667

[45] Date of Patent: Nov. 3, 1992

[54] BEARING PROTECTION DEVICE FOR LIQUID AERATORS

[75] Inventors: Peter S. Gross, Plymouth; Eric Bollensen, Columbia Heights; Richard Rajendren, Belle Plaine, all of Minn.

[73] Assignee: Aeromix Systems, Incorporated, Minneapolis, Minn.

[21] Appl. No.: 749,643

[22] Filed: Aug. 26, 1991

[51] Int. Cl.[5] ..... B01F 3/04

[52] U.S. Cl. ..... 261/91; 261/93

[58] Field of Search ..... 261/91, 93, 87

[56] References Cited

U.S. PATENT DOCUMENTS

| | | | |
|---|---|---|---|
| 3,606,273 | 9/1971 | Johnson | 261/87 |
| 3,971,104 | 2/1974 | Clitheroe | 261/93 |
| 4,086,306 | 4/1978 | Yoshinaga | 261/93 |
| 4,437,765 | 3/1984 | Seeger | 261/93 |
| 4,741,870 | 3/1988 | Gross | 261/93 |
| 4,844,843 | 7/1989 | Rajendren | 261/87 |

*Primary Examiner*—Tim Miles

*Attorney, Agent, or Firm*—Kinney & Lange

[57] ABSTRACT

An apparatus for the treatment of liquid by aeration is provided. The apparatus has a motor, a propeller carried by a motor-driven shaft, an airflow passage to the propeller, and bearings supporting the shaft at at least one location spaced from the motor. In accordance with the present invention, an air pocket is established about at least one of the bearings for keeping liquid from the bearings as by a conical member extending over the shaft from the bearing.

10 Claims, 1 Drawing Sheet

BEARING PROTECTION DEVICE FOR LIQUID AERATORS

BACKGROUND OF THE INVENTION

The present invention relates to aerators for the treatment of liquids, and, in particular, it relates to bearing protection devices for liquid aerators.

Aerators for the treatment of liquid, and particularly water, are known in the prior art. Such treatment is employed to encourage aerobic bacteria activity, as in the treatment of waste water, for example. Such equipment may also be employed in the treatment of water bodies generally; such as to render them more potable, suitable for food production, or to return them to their natural state.

An aerator typically has a motor, a propeller carried by a motor driven shaft, a passage for airflow to the propeller, and at least one bearing to support the shaft against deflection. Over a period of time, liquid will affect the bearings. When the bearings are damaged or otherwise impaired by wear or use, they need replacement. It follows that it is beneficial to prolong the life of the bearings by reducing the effects of the liquid being aerated on the bearing. Bearing seals are generally employed for this purpose in an attempt to block liquid from the bearing. The importance of the bearing protection increases with increasing corrosiveness of the liquid being treated.

If the air passage to the propeller directs the air over or past the bearing, the air flow tends to move the liquid away from the bearings during operation of the aerator. The bearing seals must still contend with back flow and splashes as well as down times when the propeller is submerged and the unit is not operational. Other aerator designs have the bearing seals submerged even during operation. In either case, liquids can seep past the bearing seal thereby reaching the bearings. The end result is that the bearings need more frequent replacement.

SUMMARY OF THE INVENTION

The present invention provides an improvement to an apparatus of the type generally described above including a motor, a propeller carried by a motor driven shaft, an airflow passage to the propeller, and bearings supporting the shaft at spaced locations along the shaft. In the improvement of the present invention, a protection mechanism is provided for establishing an air pocket about the bearings and any bearing seals. In a preferred embodiment, the protection mechanism comprises a cone-shape member situated about the shaft. The cone-shaped member extends over the shaft from the bearing location.

DETAILED DESCRIPTION OF THE PREFERRED EMBODIMENTS

Figures 1, 2, 3:
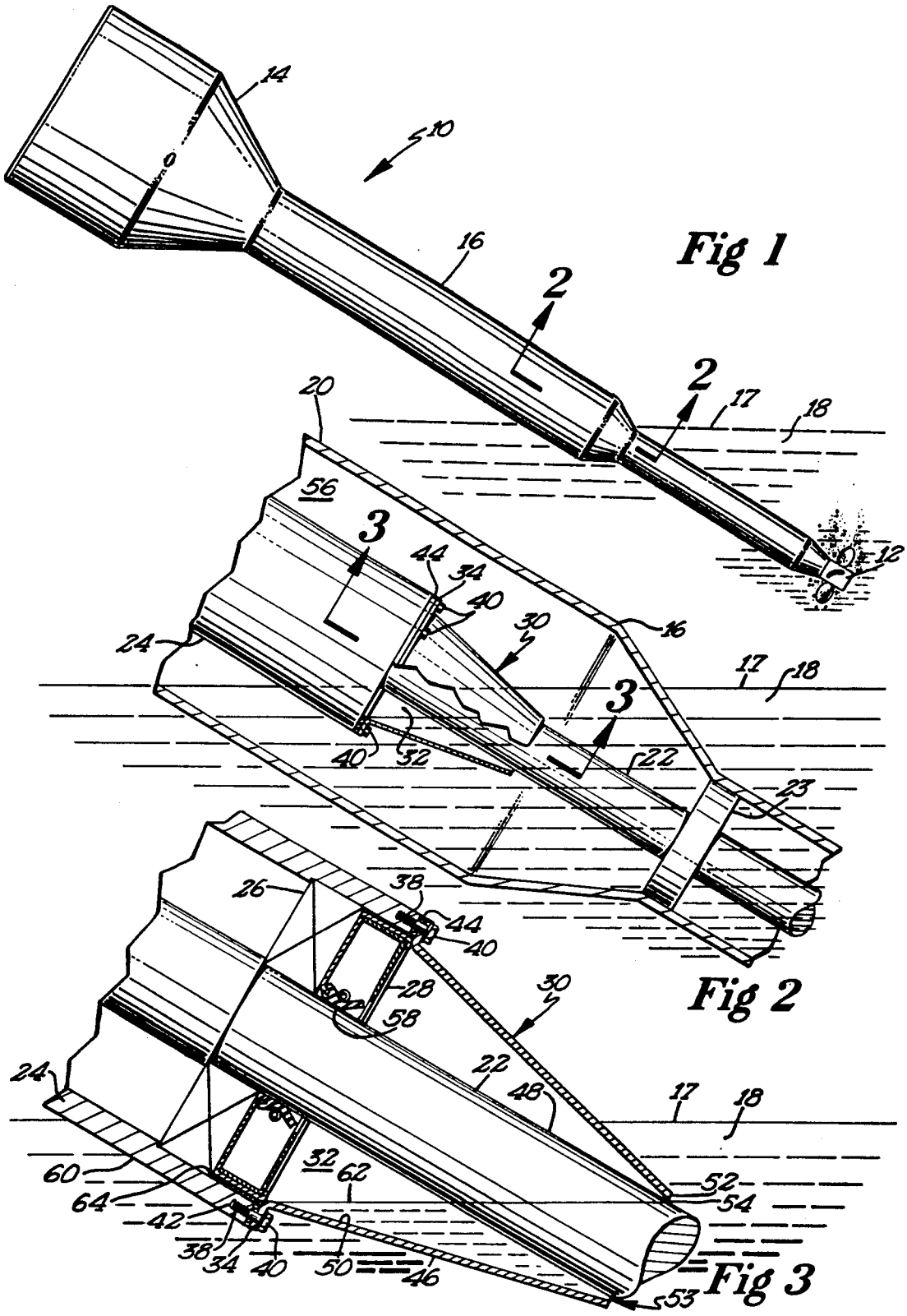
FIG. 1 illustrates the external configuration of an aerator incorporating the present invention.
FIG. 2 is a sectional view and partial cut-away taken along line 2—2 in FIG. 1 illustrating a preferred embodiment of the present invention.
FIG. 3 is a sectional view taken along line 3—3 in FIG. 2.

In FIG. 1, there is illustrated an external view of an aerator, designated generally at 10. The aerator 10 includes a motor housing or cowl 14 positioned above a surface 17 of a body of liquid 18 and a propeller 12. A leg portion 16 extends between the propeller 12 and the motor housing 14. The propeller 12 is below the liquid surface 17.

Dependent on the application, the aerator 10 may be supported at any desired angle. A typical application has the aerator oriented at approximately 30° from horizontal as illustrated in FIG. 1. The horizontal corresponds to the surface 17 of the liquid 18. The motor (within the motor housing 14) is supported above the liquid surface level 17 in any known manner (not shown) while the propeller 12 is carried by a motor driven shaft 22 (see FIGS. 2 and 3) to extend into the liquid 18 a desired distance during operation of the aerator 10. As shown, the shaft 22 drives the propeller and is within a leg 16 of the aerator 10.

In addition to the improvement of the present invention, the drawings show a typical prior art aeration device with the propeller 12, the motor housing 14 and leg 16 being as described in U.S. Pat. No. 4,741,870 which is assigned to the assignee of the present specification and which is hereby incorporated herein by reference. As illustrated in FIG. 2, the leg 16 is formed of an outer housing 20 through which the motor driven shaft 22 extends. The propeller 12 is of any type known to the art, as is its securement to the shaft 22 and communication with an air passage 56 formed by the outer housing 20. Air is drawn into and through the leg 16 on rotation of the propeller 12 within the liquid 18 and is discharged into the liquid 18 generally adjacent the propeller 12. A fan 23 facilitates airflow through the outer housing 20. The air passage 56 is further discussed below.

In the illustrated embodiment, the shaft 22 is solid while an inner housing or tubular cantilever 24 is supported at one of its ends within the leg 16 in surrounding relation to the shaft 22. The tubular cantilever 24 extends from its supported end away from the motor. As illustrated in FIG. 3, the shaft 22 is supported within the tubular cantilever 24 by at least one bearing 26 spaced from the motor along the shaft and the tubular cantilever. The bearing 26 can include tapered roller bearings or other conventional bearings to provide not only support of the shaft 22 against deflection but also against longitudinal movement under the influence of forces transmitted to the shaft 22 by action of the propeller 12 rotating in the liquid.

Typically, a bearing seal is placed between each of the bearings and the liquid in an attempt to block any liquid from the bearings. An air tight bearing seal 28 is carried by the tubular cantilever 24 in the illustrated embodiment, in known manner. The bearing seal 28 includes a bearing seal aperture 58 through which the shaft 22 passes.

Although bearing seals act to protect the bearings, over a period of time some liquid can pass to the bearings through the bearing seal. Therefore, in accordance with the present invention, a protection member 30 is provided. The protection member 30 establishes an air pocket, indicated generally at 32, about the bearing 26 and seal 28 for keeping liquid from the bearing 26. A protection member such as that illustrated at 30 may be employed with each bearing or bearing/seal combination in the aerator.

In the illustrated embodiment, the protection member 30 is attached to an end portion 60 of the tubular cantilever 24 and is preferably configured as a truncated cone.

The protection member 30 can be attached to the portion 60 of cantilever 24 by any known method, for example. The figures illustrate a flange portion 34 substantially perpendicular to a center axis of the conical protection member 30. The flange portion 34 includes a plurality of apertures 38 extending therethrough. Corresponding bolts 40 extend through the apertures 38 in the protection member 30 and are threadedly received in corresponding threaded apertures 42 in the tubular cantilever 24.

A gasket or sealing compound can be positioned between the flange portion 34 and the tubular cantilever 24 as a seal to keep liquid from entering the air pocket 32 between the flange portion 34 and the tubular cantilever 24. In addition, the sealing member acts to prevent the escape of air to the outside environment from the air pocket 32.

The protection member 30 includes a side wall 46 converging from the flange portion 34 to a point adjacent the shaft 22. Thus, the illustrated protection member 30 forms a truncated cone. A gap 53 is maintained between an outer surface 48 of the shaft 22 and an inside surface 50 of the protection member 30 at an edge 52 of the side wall 46. Preferably, the gap 53 has a width between approximately 0.001 inch and approximately 0.50 inch. The actual width of the gap is dependent upon the expected deflection of the shaft 22. A longer, thinner shaft will deflect more during operation than a shorter, thicker shaft. A greater expected deflection necessitates a bigger gap 53.

As mentioned previously, the protection member 30 establishes an air pocket 32 around the bearing 26 and seal 28. It should be noted that the protection member 30 of the present invention provides a redundant protection to the bearing 26 in conjunction with the bearing seal 28.

During operation of the aerator 10, air travels down the air passage 56 formed by the space between the outer housing 20 and the tubular cantilever 24. The air passage 56 extends from the motor housing 14 to the propeller 12 where it is discharged into the liquid being treated in a known fashion. The air travelling through the air passage 56 generally moves the liquid away from the bearing 26 and the bearing seal 28. However, the bearing 26 and bearing seal 28 will be exposed to any back flow as well as to liquid splashing into the passage 56. The protection member 30 of the present invention will shield the bearing 26 and the bearing seal 28 from liquid splashes during operation of the aerator 10.

When the aerator 10 is not operating, such as during servicing or scheduled down time during its duty cycle, liquid will tend to fill the air passage 56 to equalize the water level in the air passage 56 with the existing level 17 of liquid 18. However, by operation of the present invention, the air pocket 32 will act to exclude liquid from the interior of the protection member 30 and prevent its rise above a horizontal 62 established by an upper point 54 of edge 52 of the protection member 30. Therefore, to effectively keep liquid from reaching the bearing 26 and the bearing seal 28, the upper point 54 of edge 52 of the protection member 30 must have an elevation at or below the elevation of the lowest edge of the bearing 26, and preferably the seal 28. If the upper point 54 of edge 52 is maintained at a depth lower than the depth of the bearing 26 and bearing seal 28, the liquid level within the protection member 30 will remain below the bearing thereby keeping the liquid from the bearing 26.

Obviously, many modifications and variations of the present invention are possible in light of the above teachings. For example, the protection member 30 can consist of a cylindrical member which extends relatively parallel to the shaft. This configuration will create an air pocket effective to keep liquid from the bearings so long as the highest elevation of its edge is below the bearing or any associated seal. Typically, this will require a longer protection member than will a cone configuration. An end cap may be provided on a member of any configuration to reduce the required length of that member. In addition, although illustrated with a tubular cantilever 24 surrounding the shaft 22, it is within the scope of the invention to apply it to other types of aeration apparatuses with the same results as shown herein.

Although the present invention has been described with reference to preferred embodiments, workers skilled in the art will recognize that changes may be made in form and detail without departing from the spirit and scope of the invention.

What is claimed is:

1. In an apparatus for the treatment of liquids by aeration of the type having a motor, a propeller carried by a motor driven shaft, means defining an airflow passage to the propeller, and bearing means supporting the shaft at least one location spaced from the motor, the improvement comprising:

means establishing an air pocket about at least one bearing means for blocking liquid from the bearing means, the blocking means including an aperture which opens into the airflow passage and beneath the surface of the liquid.

2. The apparatus of claim 1 wherein the shaft is supported by one bearing means.

3. The apparatus of claim 1 wherein the blocking means comprises a cone-shaped member surrounding the shaft.

4. The apparatus of claim 3 wherein the distance between an outside surface of the shaft and an inside surface of the blocking means is between approximately 0.001 inch and 0.50 inch.

5. The apparatus of claim 3 and further comprising a housing surrounding at least a part of the shaft, the blocking means being attached to the housing.

6. The apparatus of claim 5 wherein the blocking means is attached to the housing by bolts.

7. The apparatus of claim 5 wherein the blocking means includes a flange portion and the blocking means is attached to the housing at the flange portion.

8. The apparatus of claim 7 and further comprising sealing means positioned between the flange portion and the housing to prevent air from escaping from between the flange portion and the housing.

9. The apparatus of claim 1 wherein the bearing means includes a bearing seal positioned about the shaft and between the bearing means and the propeller whereby the air pocket blocks liquid from the bearing seal.

10. In an apparatus for the treatment of liquids by aeration of the type having a motor, a propeller carried by a motor driven shaft, means defining an airflow passage to the propeller, and bearing means supporting the shaft oat at least one location spaced from the motor, the improvement comprising:

means for establishing an air pocket about at least one bearing means, the air pocket establishing means having an opening which opens into the airflow passage and defined by an edge with the edge being positioned beneath the surface of the liquid and at a depth greater than the bearing means to thereby maintain the air pocket below the bearing means and effectively exclude liquid form the bearing means.

* * * * *

UNITED STATES PATENT AND TRADEMARK OFFICE

CERTIFICATE OF CORRECTION

PATENT NO. : 5,160,667

DATED : November 3, 1992

INVENTOR(S) : PETER S. GROSS, ERICK BOLLENSEN, RICHARD RAJENDREN

It is certified that error appears in the above-identified patent and that said Letters Patent is hereby corrected as shown below:

Col. 4, line 22, after "shaft", insert "at"

Col. 4, line 58, delete "oat", insert "at"

Signed and Sealed this

Fifth Day of October, 1993

*Attest:*

*Attesting Officer*

BRUCE LEHMAN

*Commissioner of Patents and Trademarks*